US005622114A

United States Patent [19]

Dilling et al.

[11] Patent Number: 5,622,114

[45] Date of Patent: Apr. 22, 1997

[54] METHOD FOR ADJUSTING CONTACT BETWEEN TWO ROLLERS WHICH ARE ADJUSTABLE WITH RESPECT TO THEIR DISTANCE RELATIVE TO ONE ANOTHER

[75] Inventors: Peer Dilling, Friedberg; Georg Riescher, Augsburg, both of Germany

[73] Assignee: Man Roland Druckmaschinen AG, Offenbach A.M., Germany

[21] Appl. No.: 606,753

[22] Filed: Feb. 27, 1996

Related U.S. Application Data

[62] Division of Ser. No. 252,078, Jun. 1, 1994, Pat. No. 5,517,919.

[30] Foreign Application Priority Data

Jun. 1, 1993 [DE] Germany ..... 43 18 200.3

[51] Int. Cl.[6] ..... B41F 13/24

[52] U.S. Cl. ..... 101/485; 101/216

[58] Field of Search ..... 101/212, 216, 101/247, 484, 485, 486; 73/862.55

[56] References Cited

U.S. PATENT DOCUMENTS

| | | | |
|---|---|---|---|
| 2,212,820 | 8/1940 | Barber | 101/247 |
| 2,592,569 | 4/1952 | Henderson | 73/228 |
| 3,272,122 | 9/1966 | Behringer | 101/247 |
| 3,418,850 | 12/1968 | Goddin . | |
| 3,601,046 | 8/1971 | Motter | 101/247 |
| 3,760,637 | 9/1973 | Budinger et al. . | |
| 4,690,052 | 9/1987 | Paulsen | 101/216 |
| 5,201,272 | 4/1993 | Simon | 101/216 |
| 5,275,099 | 1/1994 | Kawagoe | 101/216 |

FOREIGN PATENT DOCUMENTS

| | | | |
|---|---|---|---|
| 0056643 | 7/1982 | European Pat. Off. . | |
| 0557198 | 8/1993 | European Pat. Off. . | |
| 2614792 | 10/1977 | Germany . | |
| 3408072 | 9/1985 | Germany | B41F 13/14 |
| 42093940 | 2/1993 | Germany | B41F 13/24 |
| 4135537 | 4/1993 | Germany . | |

OTHER PUBLICATIONS

Copy of Article "Die optimale Anstellung von Druckwalzen", Dr. Timm Gudehus, Böttcher, May 1985, Jun. 1985 & Sep. 1986, pp. 2–5.

*Primary Examiner*—Ren Yan

*Attorney, Agent, or Firm*—Cohen, Pontani, Lieberman, Pavane

[57] ABSTRACT

A method for adjusting contact between two rollers of a printing mechanism of a rotary printing press, which rollers are adjustable relative to one another. The method includes separating the rollers so that a gap exists therebetween, inserting a piezofilm of known thickness into the gap between the rollers at one end of the rollers and moving the rollers toward one another on the one end until the piezofilm transmits an output signal when the two rollers first make contact. Then, the rollers are separated and the piezofilm is removed from the roller gap. The piezofilm is next inserted into the gap between the rollers at the other end of the rollers after which the rollers are moved toward one another at the other end until the piezofilm transmits an output signal when the rollers first make contact. The rollers are once again separated and the piezofilm removed from the roller gap. Finally, the rollers are adjusted toward one another at both ends by an amount corresponding to the piezofilm thickness.

1 Claim, 2 Drawing Sheets

METHOD FOR ADJUSTING CONTACT BETWEEN TWO ROLLERS WHICH ARE ADJUSTABLE WITH RESPECT TO THEIR DISTANCE RELATIVE TO ONE ANOTHER

This is a divisional of application Ser. No. 08/252,078, filed Jun. 1, 1994, now U.S. Pat. No. 5,517,919.

BACKGROUND OF THE INVENTION

1. Field of the Invention

The invention is directed to devices and methods for adjusting the contact between two rollers of a printing mechanism of a rotary printing press which are adjustable with respect to their distance relative to one another.

2. Discussion of the Prior Art

In inking and dampening mechanisms in rotary printing presses, there are a great many rollers which are adjustable with respect to their distance from adjacent rollers. For example, such rollers are the inking rollers or dampening rollers which are adjusted in a determined manner to contact the form cylinder and friction cylinders.

For this purpose, it is known to effect the adjustment based upon the printing width. Yellow ink is applied to both sides of the rollers and distributed by executing a number of revolutions. The printing mechanism is then stopped for roughly 15 seconds. When the rotation of the rollers is resumed subsequently, the printing width is shown by two marks. This process is repeated for different roller adjustments until the two marks are parallel and at a desired distance from one another. This adjustment procedure is time-consuming and, due to the large number of adjustments to be made in a printing press, adds enormously to the cost of the printed material.

Furthermore, a device is known by which the rollers can be adjusted via the contact pressure. For this purpose, flexible tongues are inserted in the roller gap one after the other on both sides of the rollers. However, these tongues may not be bent during the measuring process, since this would result in incorrect measurements. This condition cannot be met in most measurement locations due to the narrow construction of the inking mechanism and the dampening mechanism.

It is also known to adjust the distance between rollers proceeding from a contacting position. Values for an optimal adjustment are determined, for example, according to a formula given in Böttcher, Gudehus, T., The Optimal Adjustment of Printing Rollers, Formula (10), offprint from printing of 5/1985, 6/1985 and 9/1986, Felix Böttcher GmbH & Co., Cologne, 1984.

A device for determining the contacting position of two rollers is shown in DE 42 03 940 A1. In this device two rollers are advanced toward one another until an elastic element is elastically deformed. Corresponding elastic elements are arranged in the bearings of one of the rollers and are deformed during a movement of the bearing pins allowed by play in the bearing as the outer surfaces of the rollers come together. This device is expensive due to the special construction of the roller bearings. Furthermore, the bearing play required for its operation is disadvantageous for the running characteristics of the rollers.

SUMMARY OF THE INVENTION

Accordingly, it is an object of the present invention to provide a device and a process for enabling the adjustment of contact between two rollers of a printing mechanism at a low cost with respect to time and technology.

Pursuant to this object, and others which will become apparent hereafter, one aspect of the present invention resides in a device for adjusting the contact between two rollers of a printing mechanism of a rotary printing press, which rollers are separated by a gap and are adjustable with respect to their distance from one another. An optical device having a transmitter and a receiver is arranged in the boundary area of the outer surface of the two rollers in their roller gap. The transmitter and the receiver are positioned opposite one another on either side of the roller gap and the receiver is connected with a display device.

In a further embodiment of the invention a pneumatic apparatus having a nozzle and a pressure sensor is arranged at the roller gap in the boundary area of the outer surfaces of the two rollers and the pressure sensor is connected with the display device.

Another aspect of the invention resides in a method for adjusting contact between two rollers of a printing mechanism of a rotary printing press, wherein the first roller is driven and drives the second roller by friction. In this method the two rollers are separated, the first roller is driven at a slow speed and then the rollers are moved toward one another at one end until the first roller drives the second roller. The rollers are moved out of contact after the point of contact has been registered. Then, the rollers are again moved toward one another, however, on this time at the other end until the first roller drives the second roller. Finally, the first end is adjusted to the point registered previously.

The invention avoids repetitive adjustment processes and accordingly saves time for making an adjustment. Further, the technical cost is low. The invention can also be applied as a partial solution in automated roller adjustment.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
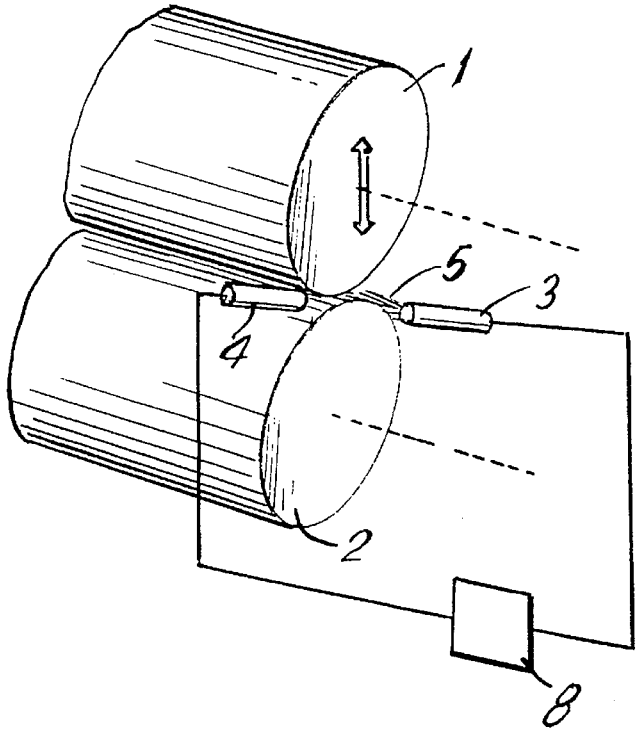
FIG. 1 shows an optical device arranged at the roller gap, pursuant to the present invention.
Figure 2:
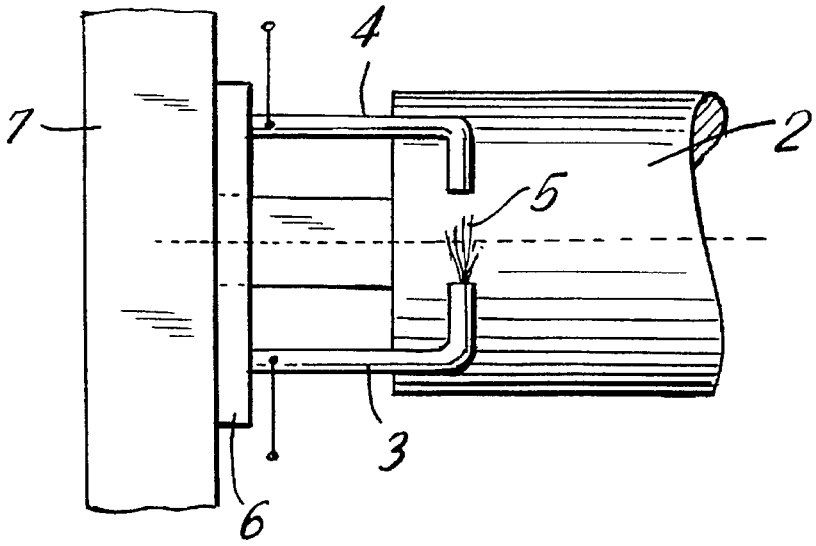
FIG. 2 is a top view of the optical device from FIG. 1.

FIG. 1 shows two rollers 1, 2 which are adjustable with respect to distance relative to one another; more particularly, the roller 1 is adjustable relative to the roller 2. For example, the roller 2 could be a friction cylinder of an inking mechanism and the roller 1 could be an inking roller which can also be brought into contact with a form cylinder, not shown. An optical device 5 having a transmitter 3 and a receiver 4 is arranged on one side of the rollers 1, 2 in the roller gap between the rollers. The transmitter 3 and the receiver 4 are positioned opposite one another on either side of the roller gap. The optical device 5 is attached to a base plate 6 which is magnetic and thus can easily be placed on the frame wall 7 of the printing press. The optical device 5 is connected with a display device 8, wherein optical fibers may advantageously be used for the purpose of miniaturization.

The optical device 5 is first introduced on one end of the rollers 1, 2 which are deliberately positioned out of contact with one another. The receiver 4 receives light emitted by the transmitter 3. The roller 1 is now adjusted toward the roller 2 until the receiver 4 no longer receives light, which is indicated via the display device 8. In this way, contact between the rollers 1, 2 is adjusted on this end of the rollers. The adjustment is effected on the opposite end of the rollers 1, 2 in the same manner, for which purpose the optical device 5 is repositioned on the other end.

Figure 3:
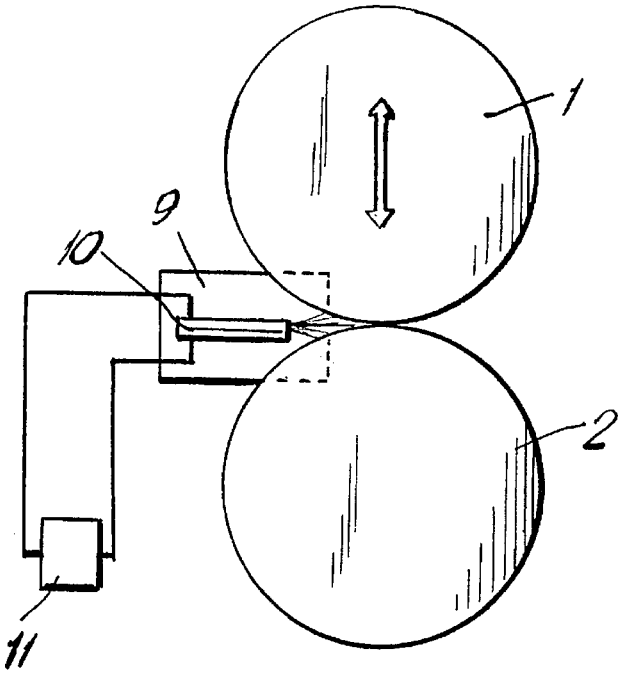
FIG. 3 shows a pneumatic device arranged at the roller gap.

FIG. 3 illustrates a different embodiment in which a pneumatic device 9 is used for adjusting the rollers 1, 2. The pneumatic device 9 is arranged at the roller gap in the boundary area of the outer surfaces of the two rollers 1, 2, similarly to the optical device 5. The pneumatic device 9 contains a nozzle 10 and a pressure sensor that is connected with a display device 11.

At first, the rollers 1, 2 are not in contact. The pneumatic device 9 is supplied with compressed air blown into the roller gap by the nozzle 10. The impact pressure in the roller gap increases as the roller 1 is adjusted toward the roller 2, which increased pressure is registered by the pressure sensor. When a maximum value is reached, the display device 11 indicates contact between the two rollers 1, 2. The rollers 1, 2 are then adjusted on the other end in the same way after repositioning the pneumatic device. The pneumatic device can also be constructed with a separate pressure sensor which is arranged on the other end of the roller gap across from the nozzle 10. In this case, the pressure registered by the pressure sensor decreases as the roller 1 approaches the roller 2 and reaches zero when the two rollers 1, 2 contact one another.

In the following, two methods are described by which contact between the two rollers is carried out in a time-saving and inexpensive manner. The first method makes use of the effect whereby a first driven roller drives a second roller when these rollers contact one another. The first roller is driven at slow speed via the inking mechanism auxiliary drive. The second roller is, at first, not in contact with the first roller and is adjusted toward the latter on one end until it begins to rotate. The point of contact is found in this way. The corresponding adjustment is registered and the roller is then backed off again. The point of contact is adjusted on the second end in the same manner. Once contact has been established on the second end, the first end call also be moved back to the registered value. The contacting line is now adjusted. The start of rotation of the rollers can either be observed visually or can be reported via suitable auxiliary means, e,g. a rotation sensor.

Figure 4:
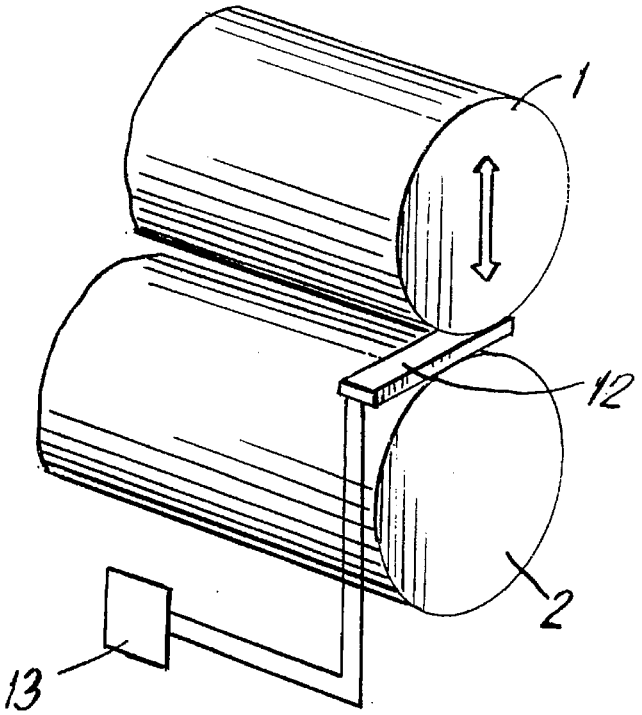
FIG. 4 shows a piezofilm arranged at the roller gap.

According to another method for adjusting the contact of two rollers, as shown in FIG. 4, a piezofilm 12 of known thickness is inserted into the roller gap on one end of the rollers 1, 2 which are at a distance from one another. The rollers are then adjusted relative to one another on this end until the piezofilm 12 transmits an output signal when the two rollers 1, 2 first contact, this output signal being indicated by a display device 13. The piezofilm 12 is now removed from the roller gap and inserted into the roller gap on the other end of the rollers 1, 2, where the adjustment process is repeated. Finally, after removing the piezofilm 12, from the roller gap, the rollers 1, 2 are adjusted relative to one another on both ends by an amount corresponding to the thickness of the piezofilm 12.

In this last method and in the devices according to the invention, there is only a small risk of accident and injury since the inking mechanism need not rotate when applying the inventive method and devices.

The way in which the rollers are moved together, which can be effected, e.g., by means of a motor, is not the subject of the present invention. After contact has been adjusted, the movement of the two rollers toward one another can also be registered by means of an inductive displacement pickup or a similar position transmitter. In this case, the invention can also be used as a partial solution in automated roller adjustment systems.

The invention has been described relative to inking rollers, however, it can also be used to adjust contact between dampening rollers or other rollers of a printing press The invention is not limited by the embodiments described above which are presented as examples only but can be modified in various ways within the scope of protection defined by the appended patent claims.

We claim:

1. A method for adjusting contact between two rollers of a printing mechanism of a rotary printing press, which rollers are adjustable relative to one another, the method comprising the steps of: separating the rollers so that a gap exists therebetween; inserting a piezofilm of known thickness into the gap between the rollers at one end of the rollers; moving the rollers toward one another on the one end until the piezofilm transmits an output signal when the two rollers first make contact; separating the rollers; removing the piezofilm from the roller gap; inserting the piezofilm into the gap between the rollers at another end of the rollers; moving the rollers toward one another at the another end until the piezofilm transmits an output signal when the rollers first make contact; separating the rollers; removing the piezofilm from the roller gap; and finally adjusting the rollers toward one another on both ends by an amount corresponding to the piezofilm thickness.

* * * * *